United States Patent [19]

Viscovich et al.

[11] Patent Number: 4,955,200

[45] Date of Patent: Sep. 11, 1990

[54] REHEATER PIPING AND DRAIN COOLER SYSTEM

[75] Inventors: Paul W. Viscovich, Longwood; George J. Silvestri, Jr., Winter Park, both of Fla.

[73] Assignee: Westinghouse Electric Corp., Pittsburgh, Pa.

[21] Appl. No.: 353,364

[22] Filed: May 17, 1989

[51] Int. Cl.[5] ..... F01K 7/40

[52] U.S. Cl. ..... 60/667; 60/678; 60/679

[58] Field of Search ..... 60/653, 678, 679, 680, 60/661, 667

[56] References Cited

U.S. PATENT DOCUMENTS 3,973,402 . 8/1976 Silvestri, Jr. ..... 60/680

4,825,657 5/1989 Silvestri, Jr. et al. ..... 60/679 X

*Primary Examiner*—Allen M. Ostrager

[57] ABSTRACT

A method and apparatus for improving a steam-to-steam reheat system employing the drain cooler concept in a steam turbine is disclosed. The large and complicated drain receiver of the prior art is eliminated, thereby removing a source of unreliable performance and internal flooding of MSR bundle drains. A drain cooler is utilized and its utility enhanced by installing a condensate bypass line with control valve which is used to adjust the condensing capability of the drain cooler in order to optimize the amount of scavenging steam for varying load conditions, thereby achieving an improvement in heat rate reduction.

13 Claims, 3 Drawing Sheets

REHEATER PIPING AND DRAIN COOLER SYSTEM

BACKGROUND OF THE INVENTION

1. Field of the Invention

This invention relates to steam turbines, and, more particularly, to an improved apparatus and method for utilizing a drain cooler in a steam-to-steam reheat drain system.

2. Description of the Prior Art

Virtually all nuclear steam turbine generators, operating under slightly wet or low superheated initial steam conditions, incorporate steam-to-steam reheat to improve thermal performance and reduce blade erosion. Rising fuel costs in recent years have led to the use of higher initial operating pressures and temperatures and additional reheat features, including an increase in the number of heaters that should be employed in a turbine cycle. The higher pressures and temperatures have led to other design developments including provision for higher outlet water temperatures by utilizing superheat of the steam, and drain cooling sections in the heaters that subcool condensate.

Current practice with respect to steam-to-steam reheater drains is to discharge the drain fluid, a mixture of condensed steam and scavenging steam, from the high pressure reheater in a moisture-separator-reheater (hereinafter MSR) to the highest pressure feedwater heater where the fluid is combined with the condensed heater steam from the first turbine extraction point. "Scavenging steam" refers to small amounts of dry steam bled from the main steam supply lines and directed through the tubes of the reheater bundle to prevent the condensate from subcooling and collecting, particularly in those tubes at the lower elevations of the bundle or the outermost U-shaped tubes of the bundle which are exposed to the lowest temperature incoming steam to be reheated. Condensate collection may result in subcooling and the associated sudden temperature change may damage piping when condensate is eventually blown from the piping by the pressure build-up. Steam-to-steam reheat designs usually employ approximately 2% of total reheater steam supply at rated load for scavenging steam to prevent moisture build-up in the reheater tubes.

From the highest pressure feedwater heater, the condensed steam and other drain flows are then discharged or cascaded seriatim to lower and lower pressure feedwater heaters until at some point in the cycle, the flows become part of the main feedwater stream.

As previously disclosed in U.S. patent application Ser. No. (53,980) filed by Silvestri and Viscovich and assigned to Westinghouse Electric Corporation, the drains leaving the MSR high pressure reheater are considerably hotter than the feedwater leaving the highest pressure feedwater heater, as much as 55° C. (100° F.) at rated load, and in excess of 140° C. (250° F.) at 25% load. Accordingly, the drains must be throttled down to the feedwater pressure prior to heat exchange. This results in a loss in thermal efficiency.

One suggested method of minimizing this loss is to pump the high pressure reheater drain fluid into the outlet of the highest pressure feedwater heater. Major drawbacks of this method are: (a) an additional pump is required; (b) the difficulty of avoiding cavitation due either to insufficient net positive suction head in steady state conditions or to flashing during transients; and (c) disposal of scavenging steam that is used to enhance the reheater tube bundle reliability.

The invention of the above-referenced application, which is incoporated herein by reference, provides a method and apparatus for improving the thermal efficiency of steam-to-steam reheating systems within steam turbine generator systems. It allows the reheater drain fluid to be directly added to the feedwater stream without the need for additional pumping, by using a drain cooler to receive the high pressure reheater drain fluid which passes the drain fluid in heat exchange relationship with condensate from the discharge of the highest pressure feedwater heater. This avoids the loss of thermal efficiency resulting from throttling of the reheater drain pressure. Heat rate improvement is greater when the system is operated at less than 100% load. The referenced invention was designed for field retrofit application to single and multi-stage moisture-separator-reheaters. These existing systems include drain receivers with level controls. Fluid from high pressure reheater drains is collected in the drain receivers and then directed to a heat exchanger (drain cooler) in heat exchange relationship with condensate from a high pressure feedwater heater. The use of a drain cooler avoids loss of thermal efficiency from throttling of reheater drain pressure.

There is a corresponding need to apply the drain cooler concept to new as well as retrofit installations. Further, there always exists the need for additional improvements in the thermal efficiency of steam generation systems while avoiding operational and maintenance problems. It is therefore a principal object of this invention to improve and enhance the drain cooler concept.

Conventional reheater drain systems customarily employ a pressure breakdown section between the MSR reheater drain connection and the feedwater heater receiving the drain fluid, and a level-controlled drain receiver to accept the condensed heating steam. There is a significant reliability problem with drain receivers, which frequently produce internal flooding in the drain tube bundle from the high pressure MSR. Such flooding has contributed to numerous damaged tube bundles, necessitating reduced load operation at impaired plant efficiency.

Further, because of the decrease in heater pressure at low loads, accompanied in many instances with an increase in reheater supply pressure, the percentage of scavenging steam increases with decreasing load. An increase in scavenging steam has a small affect on the heat rate of a cycle employing a drain cooler, as shown in Tables I and II of U.S. patent application Ser. No. (53,980).

In the absence of other control means, the amount of scavenging steam is controlled by the condensing capability of the drain cooler. Calculations for two sample plants employing the drain cooler concept, a single stage and a two stage reheat design, reveal that if the drain cooler were sized to accept 2% scavenging steam at 50% load, the scavenging steam at rated load would be in the 4.2% range for a single stage design (Table I) or 5.4% range for a two stage design (Table II). The percentage of scavenging steam would decrease as load is reduced and would remain at about 2% when operating below 50% load.

It can be seen from the third and fourth columns of each of these Tables that with rated load scavenging steam flow above 2%, there is some reduction in heat rate improvement, 1 BTU/KWH (1.055 KJ/KWH) for a two stage reheat design and 2 BTU/KWH (2.110 KJ/KWH) for a two stage design. Accordingly, it is an object of the present invention to improve heat rates at lower loads, i.e., eliminate such reduction in heat rate improvement, by providing means for optimizing the amount of scavenging steam for lower operating loads. This object is accomplished with means for adjusting the drain cooler heat transfer capability to keep the scavenging steam at 2% at all loads.

Another object of this invention is to eliminate the potential internal flooding of the bundle drains, while at the same time incorporating the drain cooler concept, to reduce pressure drops in the drain piping between the high pressure reheater bundle drain connection and terminal point at the shell side inlet of the drain cooler.

SUMMARY OF THE INVENTION

A method and apparatus for improving a steam-to-steam reheat system in a steam turbine employing a drain cooler concept is disclosed. The large and complicated drain receiver of the prior art is eliminated, thereby removing a source of potential internal flooding of MSR bundle drains. The utility of a drain cooler as set forth in co-pending U.S. patent application Ser. No. (53,980), assigned to the assignee of the present invention, is enchanced by installing a condensate bypass line with a control valve to allow adjustment of the condensing capability of the drain cooler by optimizing the amount of scavenging steam in accordance with load conditions, thereby achieving a heat rate reduction.

In one form of the invention, there is provided a steam turbine generator that employs a steam-to-steam reheating system which utilizes a small component of scavenging steam therein to prevent moisture build-up in the bottom most tubes of the reheater bundle. The system has a high pressure moisture-separator-reheater with a reheater drain, and several feedwater heaters connected in series to heat feedwater of increasing pressure. Each of the feedwater heaters has an inlet and an outlet for feedwater. The improved system of steam-to-steam reheating of feedwater comprises a drain cooler for receiving fluid from the reheater drain and passing it in heat exchange relationship with outlet feedwater from the feedwater heater having the highest pressure prior to feeding the reheater drain fluid to the feedwater heater. The system also includes means for controlling the amount of scavenging steam within the system. Furthermore, fluid level control is provided at the drain cooler heat exchanger to control the heat capacity of the drain cooler and eliminate the need for a drain receiver level control.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
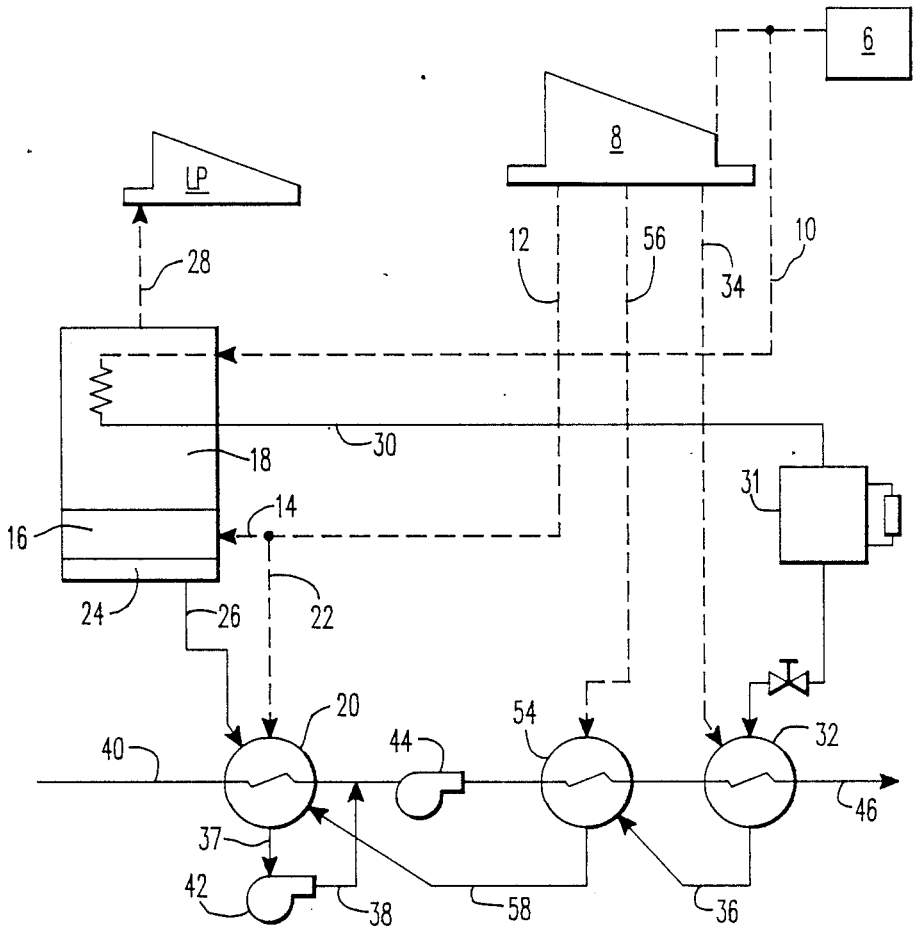
FIG. 1 PRIOR ART
FIG. 1 is a schematic diagram illustrating a portion of a conventional prior art single stage reheater plant.

Turning to the drawings, like numbers refer to like items, dotted connecting lines with arrows represent steam flow, and solid connecting lines with arrows represent flow of fluid containing water. FIG. 1 illustrates a typical installation of a single stage steam-to-steam reheat system of the prior art. A steam/water mixture or low superheated steam is taken from the steam exiting the steam generator 6 prior to injection into a high pressure turbine element 8. High pressure exhaust steam 12 from the high pressure turbine element 8 is split such that the major steam portion 14 is fed to a moisture separator 16 within a steam reheater 18. The remainder of the high pressure exhaust steam 12 is fed to a feedwater heater 20 as indicated by line 22. The portion 14 of the high pressure exhaust steam 12 that is fed to the moisture separator 16 is substantially separated such that the majority of the liquid in steam portion 14 collects in (a drain tank 24) and is fed therefrom to feedwater heater 20 via piping 26. The steam contained in the separated steam portion 14 is reheated in an upper section of the steam reheater 18 by passing in heat exchange relationship with a steam/water mixture flowing in piping 10. The reheated steam 28 is then directed to a lower pressure turbine element LP. The reheater bundle drains 30, containing predominately condensed liquid of the steam/water mixture from piping 10, is typically led to level-controlled drain receiver 31. In some existing units, a small diameter line is used to control scavenging steam flow in place of the pressure breakdown device or drain receiver 31. From drain receiver 31, the stream is fed to the highest pressure feedwater heater 32. The heating side of this feedwater heater 32 is supplemented with partially expanded extraction steam 34 from a high pressure turbine element. The exit drain fluid from heater 32 is typically cascaded to the next lower pressure feedwater heater 54 via piping 36. The exit drain fluid from heater 54 is then cascaded to the next lower pressure feedwater heater 20 via piping 58. Often, fluid drained from such a lower pressure feedwater heater 20 via line 37 is pumped directly into the feedwater lines 40 via lines 38 using a small pump 42. Also, the feedwater in lines 40 is typically pumped via pump 44 to a high pressure prior to entering feedwater heater 54 and the final feedwater heater 32, thereby ending up as a high pressure, high temperature feedwater in line 46.

Figure 2:
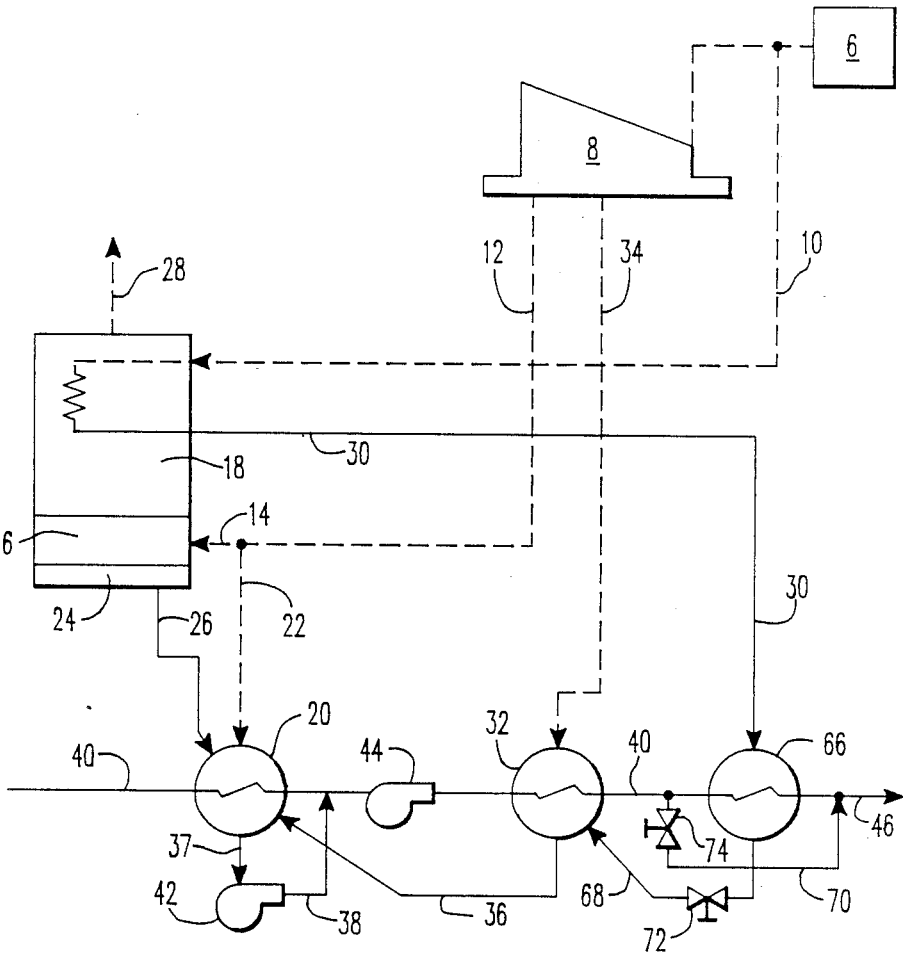
FIG. 2 is a schematic diagram illustrating a portion of a single stage reheater plant incorporating the apparatus and method of the present invention.

FIG. 2 illustrates one form of the present invention for a single stage reheater design. The major elements of the single stage reheating system as described above remain much the same. The improvement comprises removing the level-controlled drain receiver 31 together with its control valves and level control circuitry. Drain cooler 66, as disclosed in U.S. application Ser. No. (53,980), is installed to receive the steam condensate mixture from the reheater bundle drains 30. Drain fluid from the drain cooler 66 is cascaded via piping 68 to the highest pressure feedwater heater 32. A condensate bypass line 70 routes the feedwater in line 40 exiting from feedwater heater 32 around drain cooler 66 to enter the main feedwater line 46. Bypass line 70 is equipped with a valve 74 to regulate the flow in bypass line 70. The bypass line 70 and valve 74 allow independent control of the scavenging steam to meet the need for an increase in scavenging steam when required by reheater operation. Furthermore, fluid level control is provided by valve 72 connected in drain line 68 between drain cooler 66 and feedwater heater 32. By controlling fluid level with valve 72, the heat capacity of the drain cooler is controlled. The valve 72 also eleminates need for the level control previously associated with the drain receiver 31.

Figure 3:
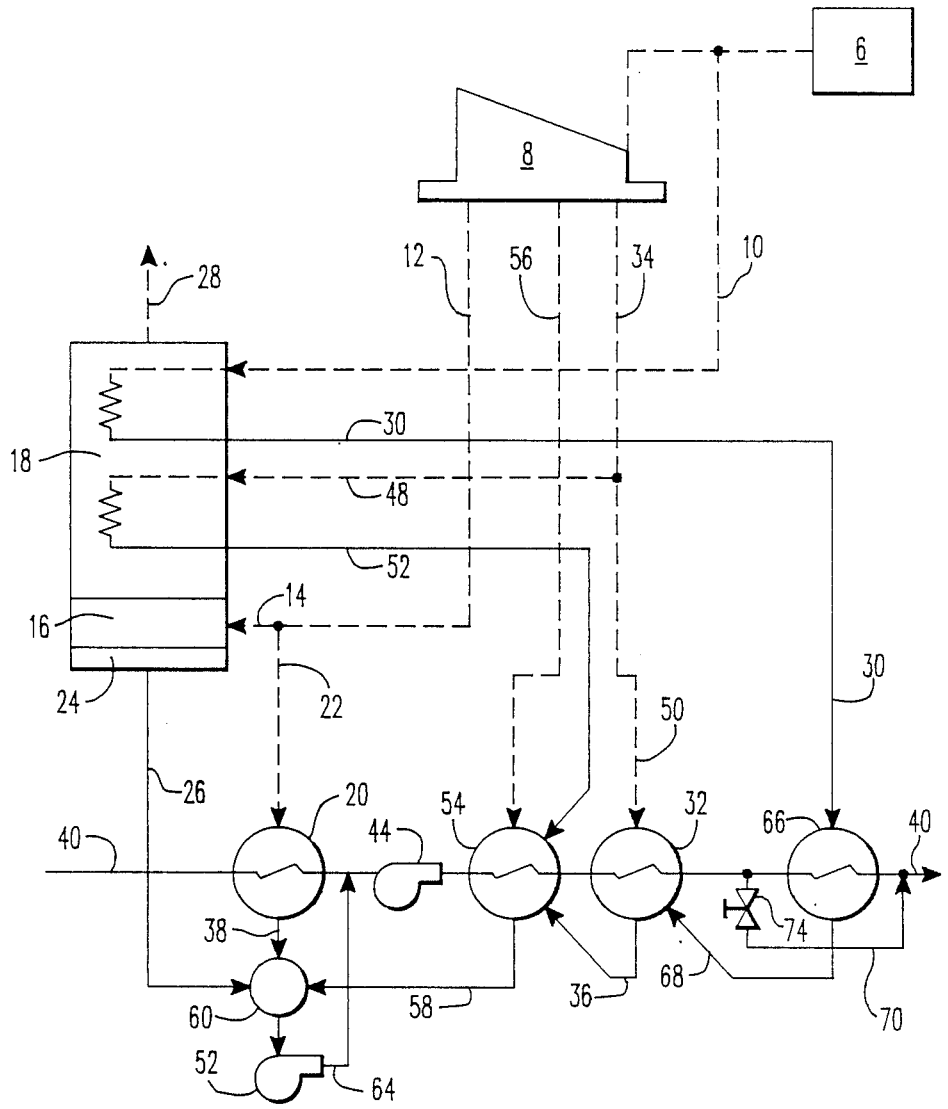
FIG. 3 is a schematic diagram illustrating a portion of a two-stage reheater plant incorporating the apparatus of the present invention.

In FIG. 3, a similar system is described except that a two stage reheat process is used. In this embodiment, partially expanded extraction steam 34 that is used solely to supplement feedwater heater 32 in the single stage design, is split into two portions and directed via piping 48 and 50 to reheater 80 and feedwater heater 32, respectively. That portion of steam 34 fed to reheater 18 enters at a point below the steam/water mixture in line 10. A second reheater drain line 52 carries the mostly condensed steam resulting from the use of steam in line 48 for reheating purposes to the second highest pressure feedwater heater 54. This reheater 54 is supplemented by additional, partially expanded extraction steam 56 from high pressure turbine element 8.

Drain condensate from the highest pressure feedwater heater 32 for the two stage design is cascaded via line 36 to the second highest pressure feedwater heater 54. Drain condensate from heater 54 is fed via line 58 to a tank 60 that receives the drain condensate from the separator section 16 of reheater 18 via line 26 as well as the drain line 38 of the third highest pressure feedwater heater 20. This tank 60 helps to avoid problems of flashing within the drain system and also eases any problems resulting from flow surges. The combined condensate from tank 60 is pumped by a small pump 52 into the feedwater lines 40 via line 64. In the two stage system, pump 44 typically would be used to raise the pressure of feedwater in lines 40 prior to directing the feedwater to the second highest pressure feedwater heater 54.

As in the single stage embodiment of the present invention, the improved two stage reheat design eliminates the level-controlled drain receiver 31 and utilizes the drain cooler 66. It also incorporates the condensate bypass line 70 equipped with control valve 74 which routes the feedwater from feedwater heater 32 around cooler 66 to the main feedwater line 40.

The aforementioned U.S. patent applicant Ser. No. (53,980) discusses the advantages of using such a drain cooler 66. The reheater drain 30 is no longer required to be throttled down to the pressure of feedwater heater 32. The problem of flashing within drain 30, with resultant cooling , is thus eliminated. High pressure operation of drain 30 substantially increases the thermodynamic efficiency of the system as well as avoiding equipment problems from thermal gradients and cavitation-erosion caused by flashing. The aforesaid application also explains that a very small heat exchanger can be employed for drain cooler 66, based on heat balance calculations, because the temperature of the MSR drain fluid 30 will be higher than the feedwater exiting heater 32.

Elimination of the level-controlled drain receiver 31, together with its complicated control valves and level control circuitry, not only simplifies the design of steam-to-steam reheat systems, but also results in reduced pressure drops in the drain piping between the high pressure MSR bundle drain connection and terminal point at the shell side inlet of the new drain cooler 66. There is also an improvement in arrangement of components and routing of drain piping because of the removal of drain receiver 31, which is typically quite large. As stated above, the new drain cooler 66 will occupy much less space, and therefore it will be easier to route the drain piping in an optimal manner. Finally, the addition of the condensate bypass line 70 together with control valve 74 permits fine tuning of the heat exchange capability of drain cooler 66, which allows independent control of the amount of scavenging steam within the MSR drain system to meet varying operational demands.

Having thus described the invention, it is to be understood that the invention is not limited to the embodiments set forth herein for purposes of exemplification, but is to be limited only by the scope of the attached claims, including a full range of equivalents to which each element thereof is entitled.

TABLE 1

| | HEAT RATES, BTU/KWH (KJ/KWH) | | |
|---|---|---|---|
| LOAD MW | BASE VAR.SCAV. STM. | HEX 2% SCAV. STM. | HEX VAR.SCAV. STM.* |
| 939 | 10121(10678.413) | 10104(10660.476) | 10105(10661.531) |
| 703 | 10228(10791.306) | 10190(10751.213) | 10191(10752.268) |
| 664 | 10280(10846.17) | 10232(10795.526) | 10233(10796.581) |
| 469 | 10926(11527.748) | 10818(11413.8) | 10818(11413.8) |
| 377 | 11401(12028.909) | 11322(11945.558) | 11323(11946.613) |
| 355 | 11547(12182.949) | 11390(12017.303) | 11391(12018.358) |

*4.2% SCAV. STM. AT 939 MW, DECREASING LINEARLY TO 2% AT 469 MW

TABLE II

| | HEAT RATES, BTU/KWH (KJ/KWH) | | |
|---|---|---|---|
| LOAD MW | BASE VAR.SCAV. STM. | HEX 2% SCAV. STM. | HEX VAR.SCAV. STM.* |
| 1260 | 9650(10181.472) | 9637(10167.756) | 9639(10169.967) |
| 945 | 9536(10061.194) | 9508(10031.652) | 9511(10034.817) |
| 630 | 10027(10579.236) | 9962(10510.656) | 9962(10510.656) |
| 320 | 11275(11895.969) | 11125(11737.708) | 11125(11737.708) |

*5.4% SCAV. STM. AT 1260 MW, DECREASING LINEARLY TO 2% AT 630 MW

What is claimed is:

1. A method for heat rate improvement in a steam turbine thermal cycle employing a steam-to-steam reheating system having a high pressure moisture-separator-reheater (MSR) with a reheater drain for fluid, a plurality of feedwater heaters connected in series to heat feedwater at increasing pressure, each of the feedwater heaters having an inlet, an outlet for feedwater, and a heat exchanger connecting in heat exchange relationship with feedwater exiting the highest pressure feedwater heater, the system utilizing scavenging steam to prevent moisture buildup, a method of improving heat rate comprising the following steps:

connecting the MSR reheater drain directly to the heat exchanger for passing the drain fluid in heat exchange relationship with outlet feedwater from the feedwater heater having the highest pressure;

drawing the drain fluid from the heat exchanger and directing it into the feedwater heater having the highest pressure; and adjusting the mass of outlet feedwater from the highest pressure feedwater heater passing through the heat exchanger to control the heat exchange capability of the heat exchanger in a manner to set the amount of scavenging steam within the system to optimally adjusted values for varying load conditions.

2. The method according to claim 1 wherein the step of adjusting the mass flow of outlet feedwater comprises the step of bypassing a variable portion of outlet feedwater around heat exchanger.

3. The method of claim 1 and including the step of controlling the mass of drain fluid passed from the heat exchanger to the feedwater heater for controlling the heat capacity of the heat exchanger.

4. In a steam turbine employing a steam-to-steam reheating system which utilizes scavenging steam therein to prevent moisture build-up, the system having a high pressure moisture separator reheater with a reheater drain, a plurality of feedwater heaters connected in series to heat feedwater of increasing pressure, each of said feedwater heaters having an inlet and an outlet for feedwater, and a heat exchanger for receiving fluid from said reheater drain and passing it in heat exchange relationship with outlet feedwater from the feedwater heater having the highest pressure, prior to feeding the reheater drain fluid to the feedwater heater, an improved system for reducig the volume of scavenging steam for varying load operation comprising means for controlling the heat exchange capability of the heat exchanger.

5. The system according to claim 4 wherein said means for controlling the heat exchange capability of said heat exchanger comprises means for bypassing a variable portion of said outlet feedwater around said heat exchanger.

6. The system according to claim 5 wherein said bypassing means further comprises valve means for controlling flow of said outlet feedwater through said bypass means.

7. The system of claim 4 wherein the means for controlling the heat exchange capability of the heat exchanger comprises means for controlling the mass of reheater drain fluid passed to the feedwater heater.

8. The system of claim 7 wherein said controlling means comprises valve means for regulating the mass flow of reheater drain fluid between said heat exchanger and the feedwater heater.

9. In a steam turbine employing a steam-to-steam reheating system which utilizes scavenging steam therein to prevent moisture build-up, the system having a high pressure moisture-separator-reheater (MSR) with a reheater bundle drain and a plurality of feedwater heaters connected in series to heat feedwater of increasing pressure, each of said feedwater heaters having an inlet and an outlet for feedwater, an improved system to steam-to-steam reheating of feedwater comprising:

a heat exchanger for receiving fluid from the MSR reheater bundle drain and passing it in heat exchange relationship with outlet feedwater from a feedwater heater having the highest pressure, prior to feeding said reheater bundle drain fluid to said highest pressure feedwater heater; and means operatively connected to a feedwater flow line coupled to said heat exchanger for controlling the volume of feedwater through said heat exchanger from the feedwater heaters to thereby regulate the amount of scavenging steam within the system as a function of loading of the turbine.

10. The system according to claim 9 wherein said means for controlling scavenging steam comprises means for controlling the heat exchange capability of said heat exchanger.

11. The system according to claim 10 wherein said means for controlling the heat exchange capability of said heat exchanger comprises means for bypassing a variable portion of said outlet feedwater around said heat exchanger.

12. The system according to claim 11 wherein said bypassing means further comprises valve means for controlling flow of said outlet feedwater through said bypass means.

13. The system of claim 9 and including a drain fluid line between said heat exchanger and said highest pressure feedwater heater for feeding said reheater drain fluid to said feedwater heater, and valve means connected in said drain fluid line for controlling the fluid level in said heat exchanger for controlling said heat exchanger heat capacity.

* * * * *